United States Patent [19]

Davidson

[11] 4,370,826

[45] Feb. 1, 1983

[54] SHUTTER SHIELDS (R), AUTO-MATED THERMAL SHUTTERS FOR GLASS AREAS

[76] Inventor: James D. Davidson, 67 Grantour Ct., Pontiac, Mich. 48055

[21] Appl. No.: 114,662

[22] Filed: Jan. 23, 1980

Related U.S. Application Data

[63] Continuation of Ser. No. 94,910, Nov. 16, 1979, abandoned, which is a continuation of Ser. No. 77,000, Sep. 19, 1979, abandoned, Ser. No. 64,354, Aug. 7, 1979, abandoned, Ser. No. 48,394, Jun. 14, 1979, Ser. No. 39,448, May 16, 1979, abandoned, Ser. No. 828,437, Aug. 29, 1977, abandoned, Ser. No. 39,449, May 16, 1979, Pat. No. 4,267,666, Ser. No. 912,186, Jun. 5, 1978, abandoned, and Ser. No. 776,448, Mar. 10, 1977, abandoned.

[51] Int. Cl.[3] ..... E05B 65/04

[52] U.S. Cl. ..... 49/63; 49/118; 49/362; 49/361

[58] Field of Search ..... 49/63, 139, 362, 370, 49/118, 361

[56] References Cited

U.S. PATENT DOCUMENTS

| | | | |
|---|---|---|---|
| 889,056 | 12/1906 | Black | 49/362 X |
| 1,478,446 | 12/1923 | McNish | 49/362 |
| 3,452,477 | 7/1969 | Sassano | 49/362 X |
| 3,469,345 | 9/1969 | Hanks | 49/362 X |
| 3,745,705 | 7/1973 | Reddy | 49/362 X |
| 4,068,799 | 1/1978 | Broden | 49/362 X |
| 4,115,953 | 9/1978 | Brosenius | 49/409 X |

FOREIGN PATENT DOCUMENTS

| | | | |
|---|---|---|---|
| 421433 | 12/1934 | United Kingdom | 49/118 |

*Primary Examiner*—Kenneth Downey

[57] ABSTRACT

This disclosure is an automated method of opening and closing thermal insulation shutters used in combination with glass windows, glass sliding doors, glass walls or solar panels and the like disposed, in large buildings such as green houses, high rise commercial buildings, super markets, auto show rooms Etc. it would be advantageous to have an automated method to open and close the shutters, using electrical controls, or even computer program means to control the movement of the shutters, the shutters could be opened or closed on demand to suit the building energy requirements, allowing solar energy to enter depending on the conditions required but regardless, by removing the human element the thermal insulation shutters would become more efficient, when used to cover solar panels to improve efficiency, they would open by a light control switch to allow solar energy to heat the solar collectors and close when light is reduced to a predetermined level thereby allowing the solar collector to remain hot for longer periods of time improving the overall efficiency, thusly reducing the amount of conventional energy used to heat or cool said buildings, dwellings or commercial, our countries energy conservation program would be greatly enhanced.

7 Claims, 16 Drawing Figures

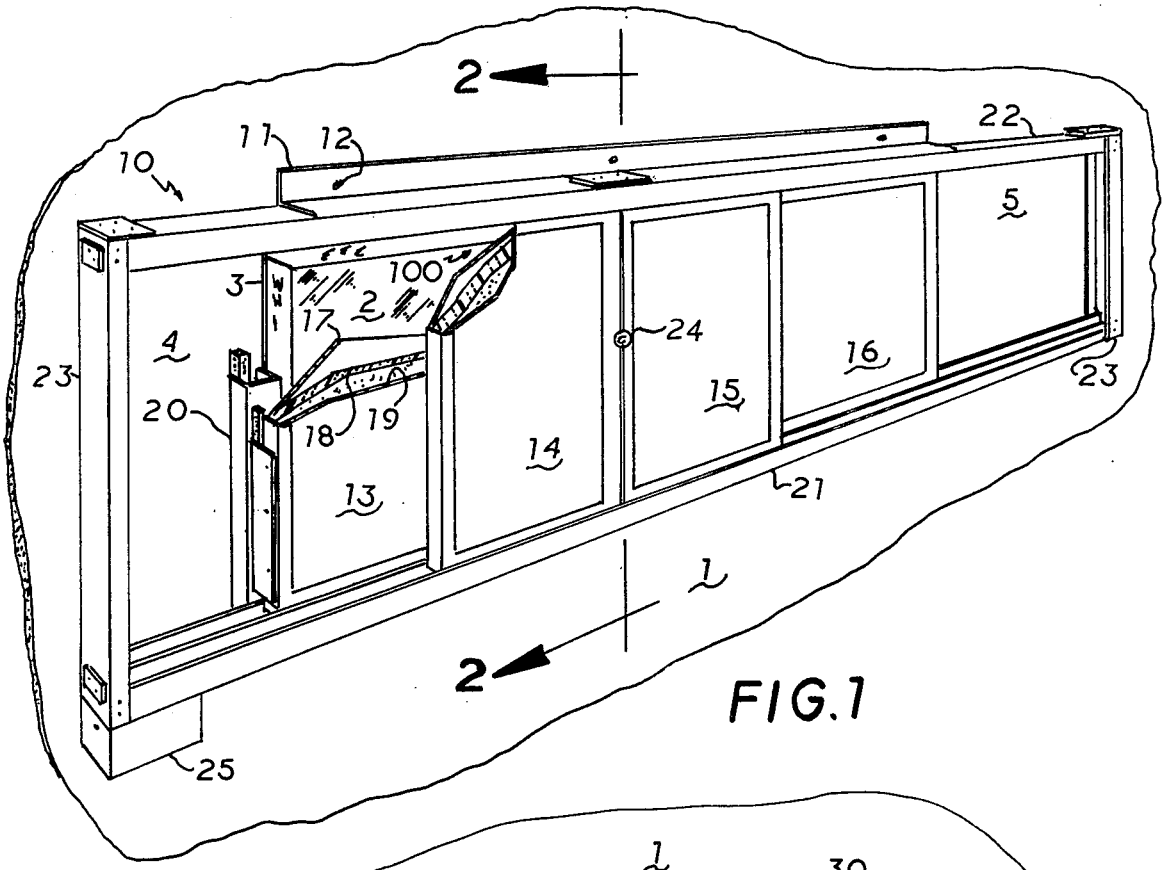
FIG. 1
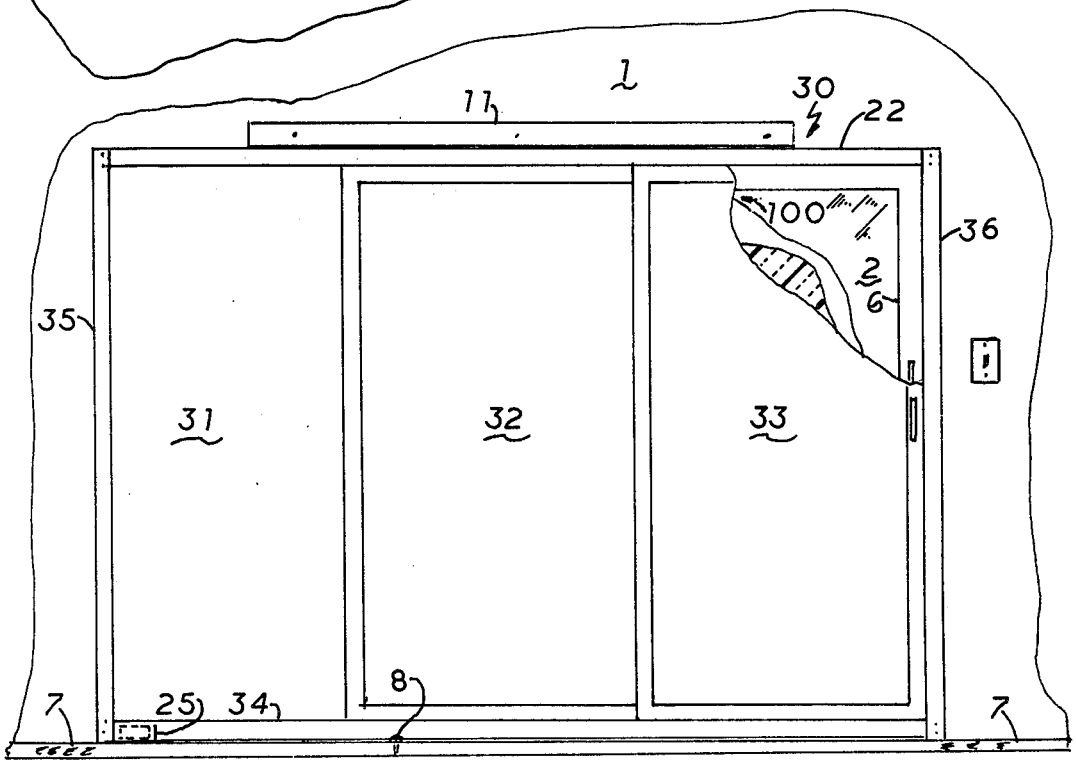
FIG. 1-A 2
4
5
3

SHUTTER SHIELDS (R), AUTO-MATED THERMAL SHUTTERS FOR GLASS AREAS

This application for letters patent is a copending continuation application continuing from patent application Ser. No. 094,910, filed 11-16-79, abandoned, which is a continuing application from patent application Ser. No. 077,000, filed 9-19-79 abandoned, patent application Ser. No. 64,354, filed 8-7-79 abandoned, patent application Ser. No. 48,394, filed 6-14-79 (pending), patent application Ser. No. 39,148, filed 5-16-79 abandoned, patent application Ser. No. 828,437, filed 8-9-77 (abandoned), patent application Ser. No. 39,449, filed 5-1-6-79 , U.S. Pat. No. 4,267,666 , patent application Ser. No. 912,186, filed 6-5-78 (abandoned), and patent application Ser. No. 776,448, filed 3-10-77 (abandoned), all were filed by applicant.

BRIEF SUMMARY OF INVENTION

This invention is an improved thermal insulation shutter device for glass areas comprising a frame construction with at least one thermal insulated shutter means with an automated means to open and slide the shutter to a storage mode or slide the shutter to a closed mode which will completely incompass said glass areas, commonly called windows, glass sliding doors, glass walls or the like, said device further comprises a track means spaced paralleling apart at the outer perimeter of said glass area, parallel to said glass area building rough opening, being mounted to the inside wall of said building attached to the structural framing, one track means, if used in combination with a glass sliding door or glass walls, can be fastened to the building floor allowing complete coverage of said glass area.

The main object of this invention is to conserve energy, reducing energy used to heat or cool a building such as a dwelling, super market, green houses, auto show rooms, or the like, reduction of heat transfer & infiltration through the glass areas, the glass area framing, and the air gaps found around the glass area framing which will reduce the energy required, thusly helping our Country's energy conservation program.

Another object is to reduce forcible entry through said glass areas which is accomplished by using a laminate shutter shield construction with at least one laminate shield layer facing outwardly toward the glass area which comprises an imperforate surface material which will provide rigidification for said insulation material, reducing the potential for forcible entry through said insulation material when outside forces are applied to the shutter means.

The improved device further comprises a thermal insulated shutter, moterized travel means which can be hand controlled by an electrical switch, timer switch, photo electrical cell, heat switch or the like, said control system can be standard electric circuitry, electronic, or even computorized, to open or close one or several shutters to suit the building conditions.

Still another usage for the device in combination with a solar panel would be a motorized thermal insulated shutter to cover and seal the solar panels, when not in use, due to lack of sun light, said device could be controlled remotely and automatically by a photo electric cell and a timing device pre-set to open the shutter and allow light to strike the heat collector panels which will heat the heat transfer agent used in the solar panel, be it liquid or air, said device will greatly improve the overall efficiency of said collectors, when the light level is reduced the insulated shutter will automatically close allowing the heat transfer agent to continue to flow until the heat collector plates are cooled down which would improve the overall efficiency greatly.

When it is desirious to have the thermal insulated shutter means stored one side only of said device, only one drive means is required to traverse said shutter means to an opened or closed mode, but to further improve said drive means a second drive means can be installed in the other parallel track means, with a connecting energy transfer means, this way said shutter means can be maintained in level, square mode of travel without tipping or sticking in said track means.

When at least one shutter means is installed on each side of the glass area it becomes necessary to have the shutter means to travel toward each other by a reversing drive means which is shown in the drawings comprising a drive shaft, having a right hand thread means and coupled with a drive shaft, having left hand thread, which is driven by a motor means causing the drive slide blocks to traverse toward each other, pulling or pushing the shutter means to a closed or opened mode through the use of drive pins.

The same applies to this drive means when the shutter means are traversed toward or away from each other, a second drive means can be installed in the other parallel track means and driven by a energy transfer means from the first shaft drive means which is driven by a motor means.

When a plurality of shutters are used come along brackets can be used to connect the driven shutter to the non-driven shutters, as the driven shutter is transversing it will eventually pick up the come along bracket and pull or push the non-driven shutters to a opened or closed mode.

This drive means will work if one shutter is used or a plurality of shutter means are used in combination with the copending applications filed by applicant, said drive means will function with minor alterations, horizontally or vertically.

A further object of the invention is to provide at least one means of a quick release means from the drive mechanism so the shutters can be manually opened quickly for emergency, this quick release means is a new use for spring pins in combination with a motorized thermal insulation shutter device.

SUMMARY OF INVENTION

This device is an improved thermal insulation shutter device to be placed over and completely encompassing glass areas to prevent heat transfer and infiltration either direction through said glass areas, a motorized means has been provided to move the shutter to a closed or opened mode and further providing a means to reduce forcible entry through said glass areas when used in combination with a window, glass sliding door or glass wall, further providing a quick means to open the shutters manually during emergency.

BRIEF DESCRIPTION OF DRAWINGS

FIG. 1-A is a typical glass sliding door with shutter storage at one side only and note that the lower track means is fastened to the building floor, the motor is shown at the lower left side mounted to the side of the lower track, the shutters are cut away to show the glass, the insulation and plus the protective shield for the thermal insulation.

FIG. 1-B is a blown up view of the device with the upper and lower track cut away to show the drive mechanism with the drive shaft with the right hand threads, the further shows the drive motor, the drive pulleys, and the energy transfer means to drive upper shafting.

FIG. 1-C is a blown up view with the lower and upper track means cut away to show the drive mechanism. Line 2—2 is actually the center line of the device, the upper track framing is cut away to show the left hand drive shaft, the drive pin, the drive block, the bearing blocks the center line shaft coupling. The lower track framing is also cut away to show the shaft coupling, the bearing block, the drive pin, the cut away drive block to show the shaft left hand threads, and further shown is the bearing block and the end support that ties the upper and lower track together.

FIG. 4-A is a section taken on line 4-A—4-A showing the drive block and drive pin in the thermal insulated shutter.

DETAILED DESCRIPTION

Figure 1B:
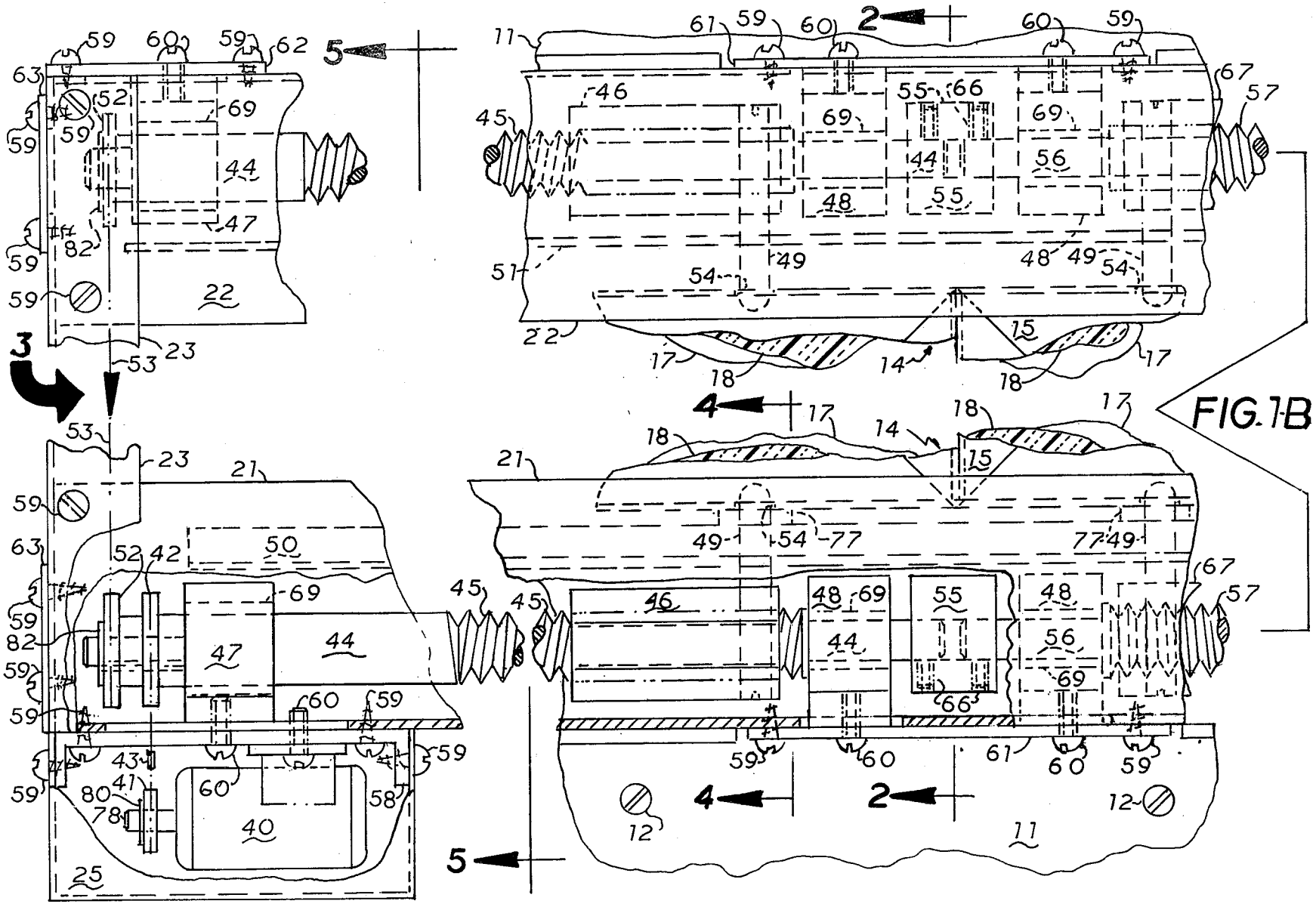
FIG. 1 is a perspective view of a typical thermal insulation shutter device fastened to a wall completely encompassing and sealing a building glass area commonly called a window. The shutters are cut away to show the window glass and the window trim, and also shows how the device seals at the edge of the window, further shown is the motor housing at the left side of the lower track. Note the device has shutter storage at both sides.

Reference is now made in great detail to FIGS. 1 through 12 of the drawings which are illustrative only and wherein like elements are designated by the same reference numerals.

FIG. 1 is a perspective view of a four shutter thermal insulation device 10 mounted on a building wall 1 with a wall mounting bracket 11 and metal fasteners 12, the four shutters are 13,14,15, and 16 which are shown in a closed mode and cut away exposing the glass area 2, and the glass area trim 3, further showing the outer shield means 17, the thermal insulation 18 and the inner decorative laminate layer 19, further shown is the cam seal support bar 20 which seals the shutters at the sides of glass area and provides a seal at the rear of the shutter 13 and 16 and helps tie the assembly together, further shown is track means 21 and 22 which are further tied together with end supports 23, areas 4 and 5 denotes the storage area for the shutters when in a opened mode, a lock means 24 is shown to lock the shutters when in a closed mode, further shown is the motor cover 25, FIG. 1 is a four shutter device with shutter storage on both sides of the device, when in a closed mode they will reduce heat transfer and infiltration either direction through the glass 2, the glass framing, and the air gaps under the trim 3 which are found around the outer perimeter of all glass areas, thereby conserving energy, the shield means 17 is a rigidification, imperforate surface layer, facing outwardly toward the glass 2, it helps prevent forcible entry through said thermal insulation 18.

Numeral 100 denotes the sealed chamber between the thermal shutters and the glass 2. It should be noted the most simple form of this improved motorized thermal shutter device would be using one shutter only, stored at one side of the window, but to demonstrate all the problems solved by the invention a four shutter device is shown in FIG. 1, FIG. 1-B and FIG. 1-C.

To further demonstrate some of the problems solved by the improved invention, FIG. 1-A has been added to show a glass sliding door or a glass wall, FIG. 1-A is a two shutter device 30 with shutters storage 31 at one side only, device 30 has two thermal shutters 32 and 33, shutter 33 has been cut away to show the glass 2 and the door frame 6 setting in the lower track means 34 fastened to the building floor 7 with the metal fastener 8, the side support 35 helps tie the upper and lower track means 34 and 22 together, side support 36 is used to seal and lock the shutters when in a closed mode, further shown in FIG. 1-A is motor cover 25 which is mounted on the side of the track means 34.

FIG. 1-B is a blown up view of the drive mechanism showing the track framing deliberately cut away to show the working details more clearly, some details are cut away to further show more detail of how the device operates. The motor cover 25 has been cut away to show the motor 40 and the motor drive pulley 41 which drives shaft pulley 42 through the energy transfer means 43, shaft pulley 42 turns in a clockwise motion and is keyed to drive shaft 44 which turns shaft 44, which has a right hand thread 45 causing the drive slide blocks 46 to slide toward the center line of the device or line 2—2, shaft 44 is mounted in bearing blocks 47 and bearing blocks 48, drive pin 49 is located in the drive slide block 46 and extends through slot 50 in the track 21 into the shutter 14 which pushes or pulls the shutter 14 to a closed or opened mode, to further improve the device a second shaft is shown in track means 22 which is identical to track means 21 except the pulley 42 is not required in track 22, pin 49 is inserted into shutter 14 and when the motor 40 turns the shaft 44 it will turn the drive means 52 in the track means 21 which is tied to the drive means 52 in the track means 22 and through the energy transfer means 53, consequently when both the shafts 44 turn the drive slide blocks 46 will slide with the drive pins 49 placed in the holes 54 in the shutter 14 which will pull or push the shutter 14 to a closed or opened mode.

The object of using a shaft in both track means 21 and 22 and pulling or pushing the shutter from two sides is to prevent tipping or sticking of the shutter.

When the shutters are stored the both sides of a glass area then it is necessary to have the drive slide blocks with drive pins on both sides of the center line of the device that traverse toward each other when the shutters are closed and to traverse away from each other to open the shutters and store them at the sides of said glass area, FIG. 1-B represents one half of said device, note, the shaft coupling 55 is a connecting link between shafts 44 and 56 and allows the shafts 44 and 56 to turn clockwise when it is desirous to close the shutters 14 and 15, driving, the drive pins 49 toward each other, to open the shutters 14 and 15 it is necessary to reverse the motor allowing shafts 44 and 56 to turn counter clockwise traversing the drive pins 49 away from each other therefore moving the shutters 14 and 15 to the storage areas 4 and 5 at the sides of the glass area.

FIG. 1-B further shows the motor 40 the bearing block 47 and the mounting plate 58 fastened to the track means 21 with metal fasteners 59, the metal fasteners 60 are used to fasten the motor 40 and the bearing block 47 to the mounting plate 58, also shown in FIG. 1-B is center line mounting plate 61 which is used to mount the bearing blocks 48 which are fastened to the plate 61 with metal fasteners 60, the metal fasteners 59 are used to fasten the mounting plate 61 to the track means 21, plate 62 shown on the track means 22 is used to mount the bearing block 47 with the metal fasteners 60 and is fastened to the track means 22 with metal fasteners 59, excess plates 63 can be removed by removing the metal fasteners 59, allowing excess to the drive means 52.

FIG. 1-C is symetrical about the line 2–2, except drive shafts 56 has a left hand thread and it is not necessary to have the drive means 52 on the end of the shafts. Track means 21 and 22 have been cut away to show the drive means details and some details have also been cut away to show how they fasten together, cut away coupling detail 55 in the track means 22 shows one means how the shaft 44, having right hand thread 45 is, fastens to the shaft 56 with a left hand thread 65, coupling 55 is fastened to shafts 44 and 56 with metal fasteners 66, bearing block 48 has been cut away to show the shaft 56 which will turn in the bushing 64 to reduce friction and wear, further shown is drive block 67 cut away to show the threads 68 on drive pin 49, thread 68 is used to hold the pins in the drive blocks 46 and 67, but also allows pins 49 to be removed from the shutters 14 and 15 which allows the shutters to be manually moved to a closed or opend mode, track means 22 was further cut away to show bearing block 47 which has been cut away to show bushing 69 which will reduce friction and wear, numeral 70 denotes a snap ring on the end of shaft 56. Wall mounting bracket 11 is shown and fastening means 71 is shown which is a metal fastener through a slotted hole 72 in the mounting bracket it, allows the track to be moved toward or away from the building wall, not shown, to provide for different thickness of window trim or different widths of window sills. Track means 21 has been cut away to show shaft 44, coupling 55, bearing block 48, drive block 67 with drive pin 49 inserted into the shutter 15, drive slide block 67 has been cut away to show the left hand thread 65 on shaft 56, further shown is bearing block 47, and connecting means 23 for tieing track means 21 and 22 together.

Figure 1C:
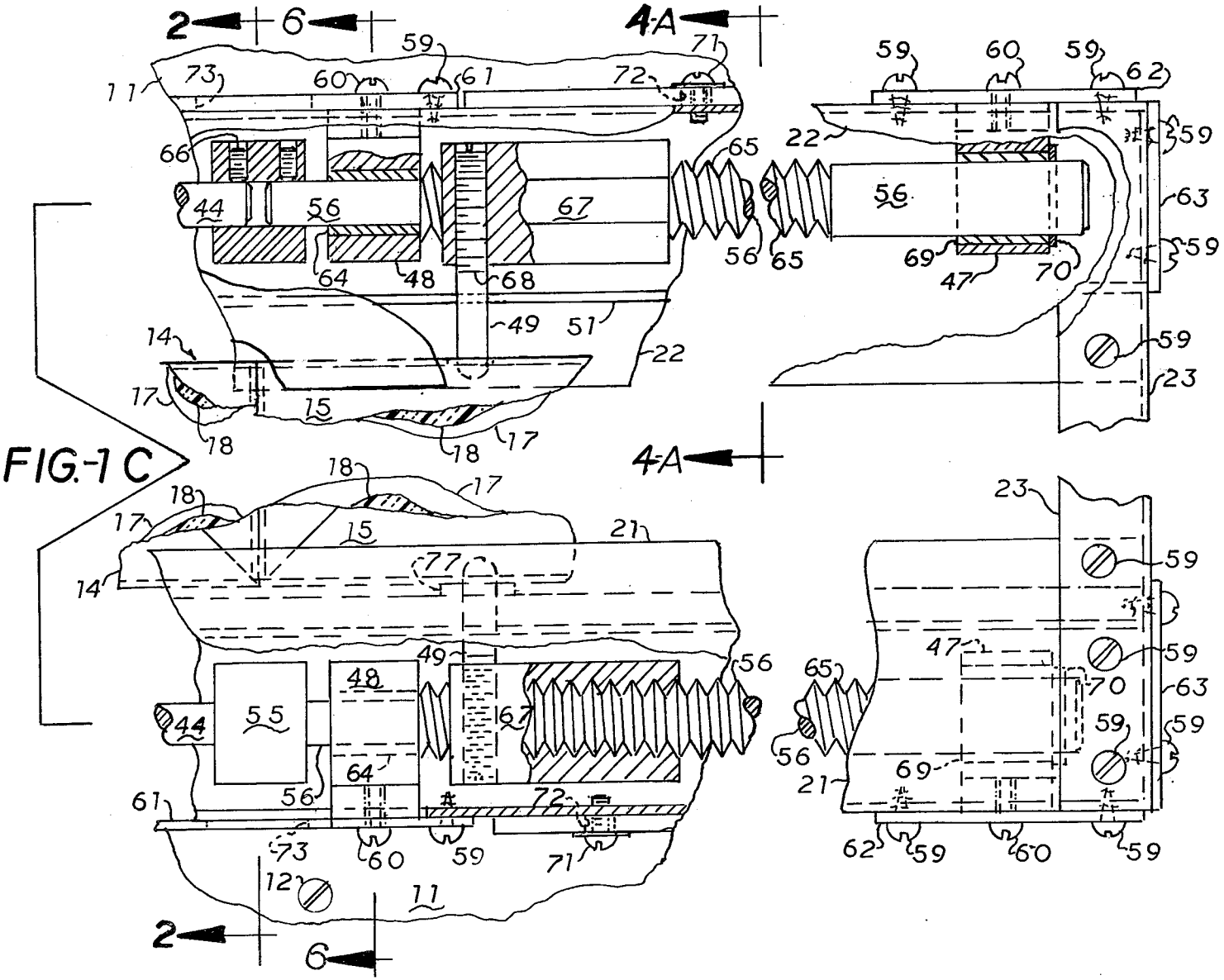

To further disclose the improvement invention several sections have been cut on FIGS. 1B and 1C showing all details of the drive means.

Figures 2, 3, 4, 4A:
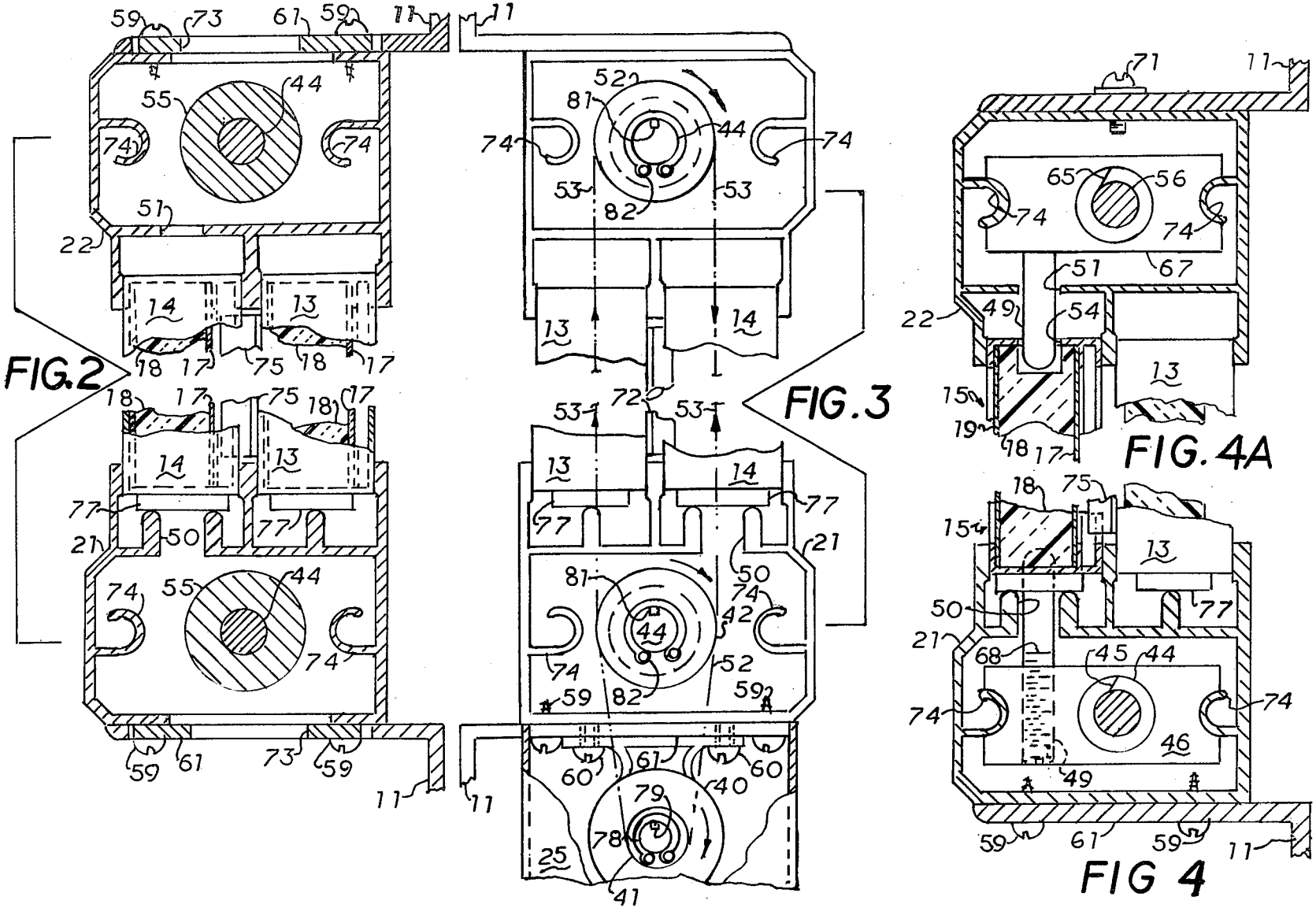
FIG. 2 is a section taken on the center line which is line 2—2 showing the upper and lower track mounting brackets, the upper and lower track framing, and the upper and lower drive shafts with the shaft couplings.
FIG. 3 is a end view taken in the direction of arrow 3 with the end support removed to show the motor, the drive pulley and transfer chain to drive the upper shafts.
FIG. 4 is a section taken 4–4 showing the drive slide block mounted on the extruded guide ways, and further showing the drive pin in the shutter.

FIG. 2 is a section cut on line 2—2 showing both track means 21 and 22 and the wall mounting brackets 11, also shown is bearing mounting plate 61 fastened to the track means 21 and 22 with metal fasteners 59, an access hole 73 has been provided to allow coupling 55 metal fasteners to be removed so shafts 44 and 56 can be removed, further shown are the guide ways 74 which keep the drive slide blocks 46 and 67 from turning on the shaft 44 and 56.

FIG. 2 also shows the thermal insulation shutters 14 and 13, note the: come along bracket 75 is fastened to the shutter 13 with metal fasteners 76 the, come along bracket catches shutter 14 which allows the shutter 13 to move along with shutter 14 to a opened or closed mode, shutters 13 and 14 rest on frictionless slide blocks 77 and slide in the track means 21 the, slots 50 and 51 in the track means 21 and 22 are clearance for the drive pin 49.

FIG. 3 is an end view of a device 10 showing the track means 21 and 22 and wall mounting brackets 11, note: end support bracket 23 has been removed, the motor cover 25 has also been cut away to show the motor 40 with the motor drive pulley 41, the drive pulley 41 is keyed to motor shaft 78 with key 79 and further held on motor shaft 78 with snap ring 80. The arrow denoted clockwise motion when the motor is energised by a remote switch the, motor pulley 41 turns and drives, shaft pulley 42 in a clockwise direction through use of a drive energy transfer means 43, drive pulley 42 is hidden behind drive means 52 but both are keyed to drive shaft 44 with key 81 and retained on shaft 44 with snap ring 82, further describing the drive means motion the, energy transfer means 53 is driven in a clockwise direction by drive means 52, in track means 21, thusly turning the drive means 52 in the track means 22.

FIG. 4 is a section taken through track means 21 showing how drive slide block 46 is allowed to traverse on guide ways 74 when shaft 44 turns the, drive pin 49 is shown through the track slot 50 and into the shutter 14, which will pull or push the shutter 14 which will in turn pull or push the shutter 13 through use of the come along bracket 75, thereby, sliding shutters 13 and 14 to a closed or opened mode.

FIG. 4A is a section taken through track 22 showing drive slide block 67 with traversing means on the guide ways 74 and driven by shaft 56 which has a left hand thread 65, drive pin 49 is shown through the track slot 51 and into the thermal insulation shutter 14, said drive pin 49 pushes or pulls the shutters 15 and 16 to a opened or closed mode.

Figure 5:
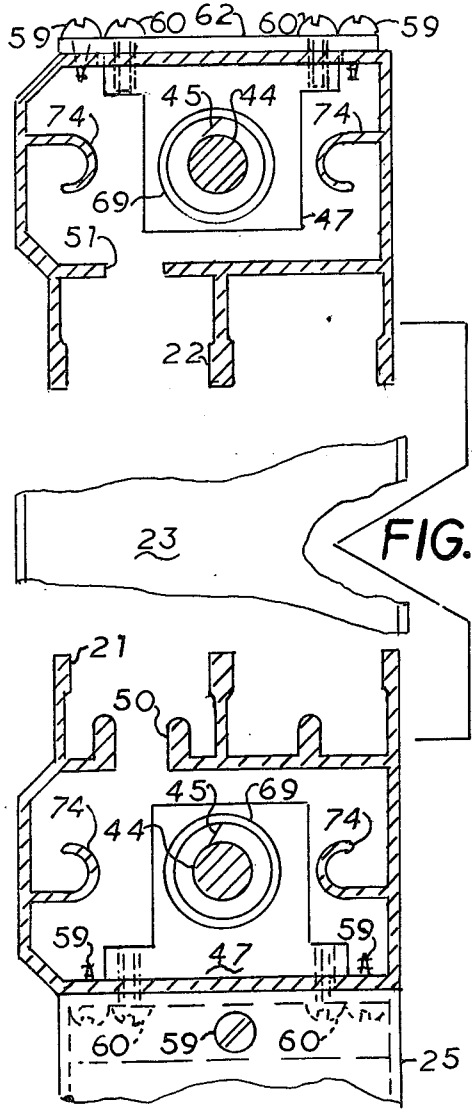
FIG. 5 is a section taken on line 5—5 which shows the drive shafts and the bearing blocks.

FIG. 5 is a section taken through track means 21 and 22 showing bearing blocks 47 mounted to mounting plate 62 with metal fasteners 60 which is further fastened to the means 21 and 22 with metal fasteners 59, this section shows the bushing 69 in the bearing block 47 which will reduce friction and wear when shaft 44 turns.

Figure 6:
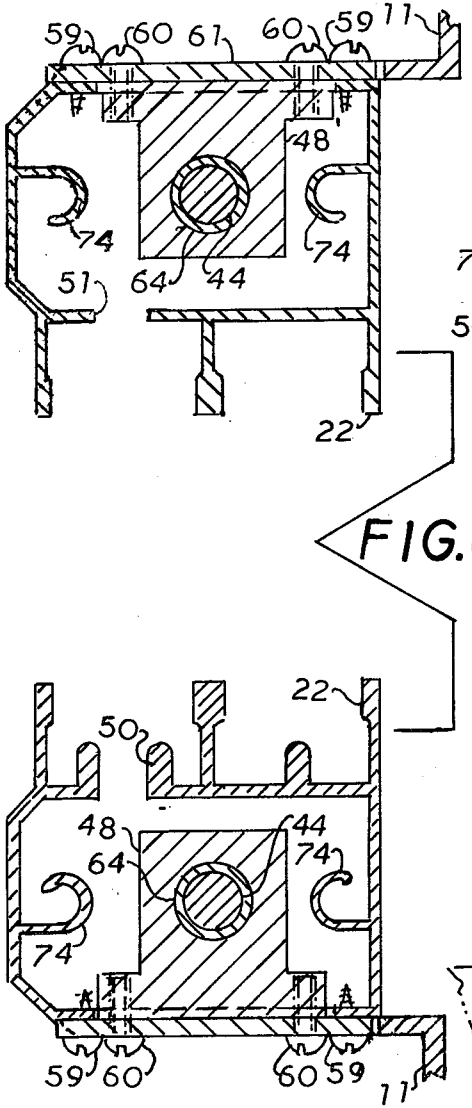
FIG. 6 is a section taken on line 6—6 which shows the cross section of the bearing blocks.

FIG. 6 is a section taken through shaft bearing blocks 48 which shows bushing 64 which will reduce friction and wear and also shows how blocks 48 are mounted in the track means 21 and 22.

Figure 7:
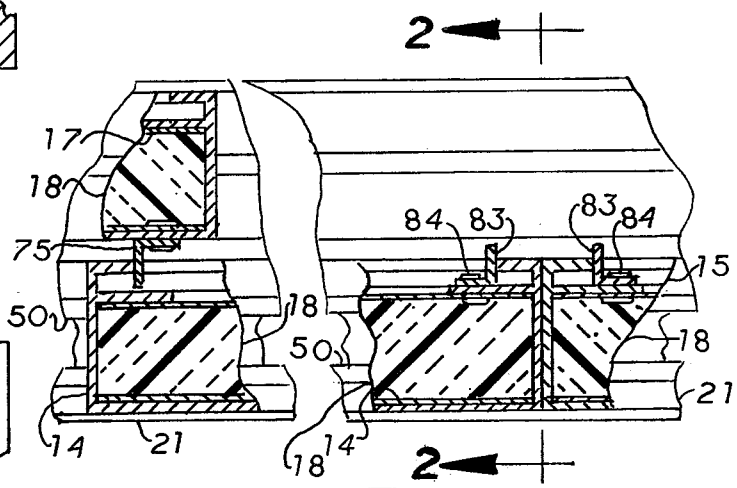
FIG. 7 is a typical section of a plan view showing the shutters in a closed mode showing the combination sealer and the come along bracket between the shutters, it also shows the opening come along bracket that pushes the shutter to a opened mode when more than two shutters are used.

FIG. 7 is a typical section, through the shutters 13,14, and 15 in a blow up showing a plan view of the track means 21 to demonstrate how the come along bracket 75 works between the shutters 13 and 14 and how an additional come along brackets 83 can be used to help the shutters to a opened mode.

The come along bracket 75 can be used to open and close the shutters 13 and 14 but the additional come along bracket 83 is used only to push the shutter to a opened mode.

Figure 8:
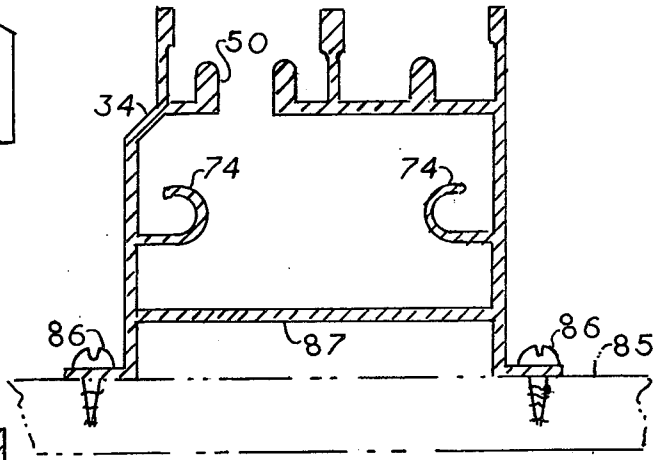
FIG. 8 is a typical section through the track and track framing when the lower track is mounted to the floor in combination with a glass sliding door or glass wall.

FIG. 8 is a typical section taken through track means 34 shown in FIG. 1-A to be used in combination with a thermal shutter device which is placed over a glass sliding door 6 or a glass wall that extends to the floor. Track means 34 is fastened to the building floor 85 with metal fasteners 86 or even to a building ceiling when the glass area extends to the ceiling, off set 87 is provided for clearance for the bearing mounting plates and the metal fasteners, otherwise the track means 34 is identical to track means 31 and 22.

Figures 9, 10, 11, 12:
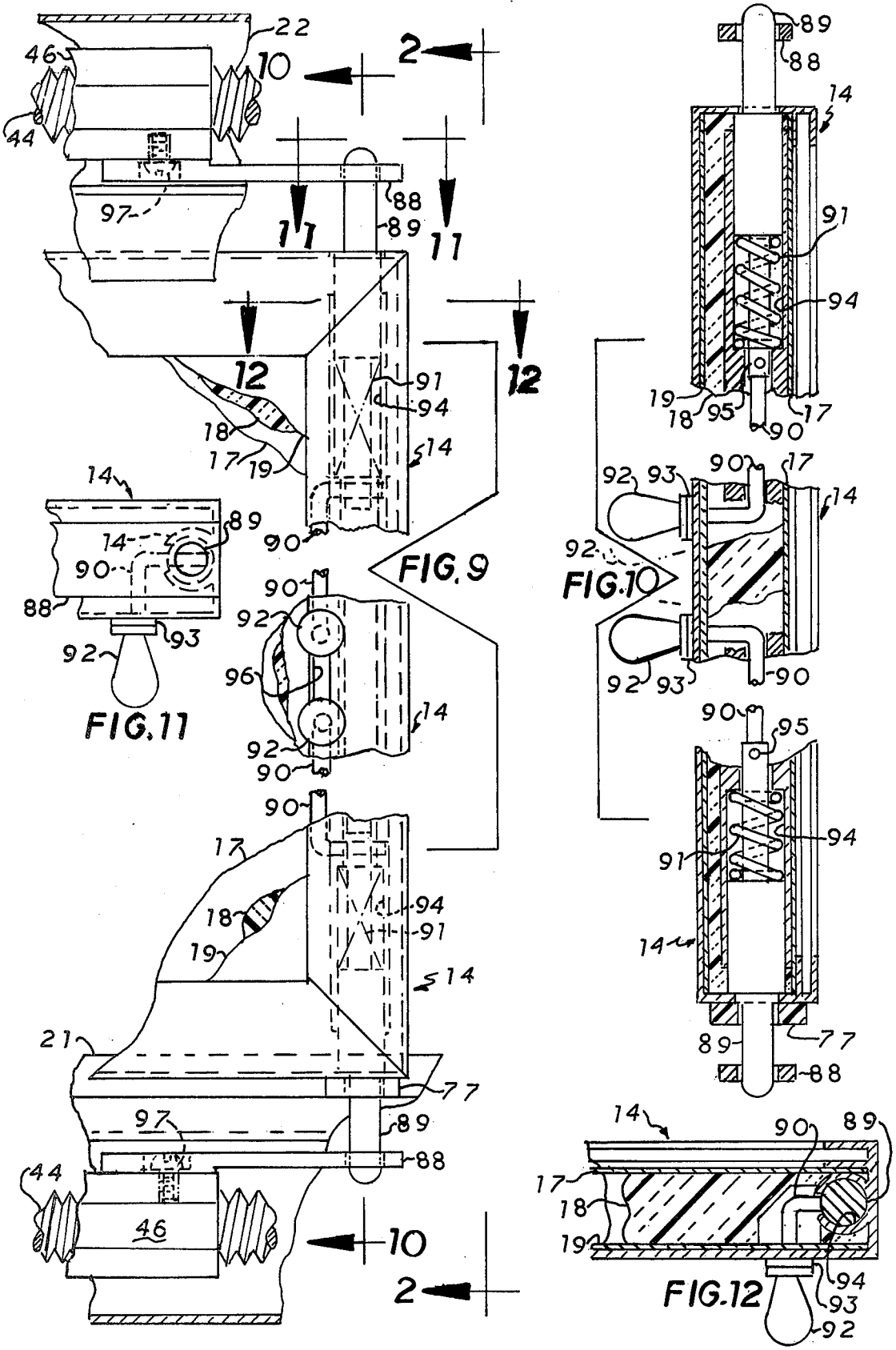
FIG. 9 is a typical method for quick release of the shutters using spring pins which will dis-engage the drive block for emergency.
FIG. 10 is a section taken on line 10—10 showing the spring pins, the springs and the pull down rods.
FIG. 11 is a plan view taken in direction of line 11—11 showing the spring pin engaged in the drive block extension plate.
FIG. 12 is a section taken on line 12—12 showing the spring pin, the pin pull down rods and the handles.

FIG. 9 is one method of installing the drive pins 89 into the shutters 14 and 15 which provides a safety feature for quick release of the shutters 14 and 15 from the drive slide block means 46, when the handles 92 are squeezed toward each other they disengage the pins 89 from the extension plates 88 allowing the shutters to be quickly, manually opened in emergencys or allows continued usage of the shutters if the drive means breaks down.

FIG. 9 is a blown up view of shutter 15 taken at line 2—2 showing the track means 21 and 22, plus the drive block 46 with the drive shafts 44 the, drive blocks 46 have an extension plate 88 attached with metal fasteners 97, the extension plate extends to the pin 89 which it engages and traverses the shutters to an the opened or closed mode the, pin 89 is spring operated and placed in the extruded framing in a drilled hole 94 and is fastened to the pull rod 90 which extends to the pull handle 92, pull rod 90 is installed through the slot 96 in the shutter and fastened to the handles 92 the, handles 92 will slide toward each other when squeezed numeral the, 93 designates a slide washer to reduce the fricition and wear.

FIG. 10 is a section taken on line 10—10 along the center line of the pins 89, all detail has been eliminated other than what is required to clearly demonstrate the improvement.

The extension plates 88 are shown with pins 89 engaged, spring pins 89 are installed in the drilled holes 94 and setting freely on the coil springs 91, pins 89 are fastened to the pull rods 90 which are inserted in holes 95 in the pins 89, pull rods 90 continue until they are extended outward through shutter slot 96, through the slide washer 93 and threaded into the handles 92, the hidden lines denote the position handles 92 would be when manually squeezed, therefore releasing the spring pins from the drive means extension plate 88.

FIG. 11 is a plan view taken on line 11—11 of the extension plate 88 with the pin 89 engaged the, also demonstrates how the pull rod 90 ties the spring pin 89 and the handle 92 together.

FIG. 12 is a section taken on line 12—12 the, shows the pin 89 setting in the hole 94 with the, pull rod 90 attached to the handle 92.

I claim:

1. An improved building structure with upright walls having a glass area means commonly called a window or glass sliding door installed therein, said glass area means including a frame and a glass panel means mounted in said frame, in combination with an insulated shutter shield device having upper and lower track means spaced inwardly of said glass area at least one height dimension of said glass area frame and attached to the internal wall structural framing of said building wall structure and parallel to the plane of said glass area means;

laminate insulative shutter shield means mounted in said track means for movement between positions adjacent to the side of said glass area means and in front thereof, to block off the entirety of said glass area means, low friction means for supporting said laminate insulative shutter shield means for movement on said track means, said laminate insulative shutter shield means having rigidifying means and an insulative material layer mounted side by side, said insulative material having little resistance against breakage when forces are applied in the direction perpendicular to the plane thereof, said rigidifying means providing a rigidification of said insulative material against the effects caused by forces applied from the outside, and seal means for effecting a seal around the periphery of said glass area means and between said glass area means and said insulative shutter shield means, thereby defining a sealed chamber;

said improved insulative shutter shield device having a motorized means for traversing said insulative shutter shield means to an opened or closed mode, wherein the improvement comprises:

said traversing means having a motorized, threaded drive shaft means maintained in a mode of rotatable precision alignment housed in said lower track means;

a drive slide block means having a shutter drive pin means installed therein, extending vertically at right angles to said drive slide block means, said drive slide block means is threadedly disposed in a non-rotatable mode on said threaded drive shaft means; and at least one insulated shutter shield means is installed in said track means engaging said vertical extending shutter drive pin means; whereby said motorized traversing means opens or closes said insulated shutter shield.

2. An improved insulated shutter shield device having upper and lower track means as recited in claim 1 in combination with a gladss area having shutter storage on both adjacent sides of said glass area, and a motorized means for traversing said insulated shutter shield means from said shutter storage area to a point blocking said glass area means, wherein the improvement comprises:

said traversing means having a motorized threaded drive shaft means with right hand thread means disposed on one side of the vertical center line of said drive shaft means and left hand thread means disposed on the opposite side, said drive shaft means is maintained in a mode of rotatable precision alignment, housed in said lower track means;

at least two drive slide block means having a shutter drive pin means installed therein, extending vertically at right angles to said drive slide block means, said drive slide block means are threadedly disposed in a non-rotatable mode on said drive shaft means equadistant from said drive shaft vertical center line;

at least one insulated shutter shield is installed in said track means on each side of said vertical center line, engaging said extending shutter drive pins, whereby said motorized traversing means can open or close said insulated shutter shields.

3. An improved insulated shutter shield device having upper and lower track means in combination with a glass area installed in a building wall as recited in claim 1, said improved shutter shield device having a motorized traversing means housed in said lower track means, wherein the improvement comprises:

a shutter shield drive pin means is installed in said insulated shutter shield means, said pin is disposed, engaging said lower motorized traversing means, said drive pin means having quick release means, whereby said shutter shield means is quickly separated from said motorized traversing means; whereby providing for manual operation of said insulated shutter shield means during a break down of said motorized traversing means or during emergencies.

4. An improved insulated shutter shield device in combination with a glass area located in a building wall, said shutter shield device comprising upper and lower track means maintained in a parallel mode of precision alignment and spaced apart at least one height dimension of said glass area, said shutter shield device having at least one insulated laminated shutter shield installed in said track means on each side of said devices vertical center line, whereby said improved shutter shield devices upper and lower track means houses a motorized shutter shield traversing means for traversing said insulated shutter shields from a storage area located at the adjacent sides of said glass area to a point blocking said glass area in its entirety, wherein the improvement comprises:

means for maintaining said upper and lower track means in a parallel mode of precision alignment, said means being vertical support members, spaced parallel at right angles to said track means with means to fasten said vertical support members to said upper and lower track means;

a first and second threaded drive shaft means is housed in said upper and lower track means maintained in a mode of rotatable precision alignment, said first and second drive shaft means having opposing right hand thread means disposed on the right side of said devices vertical center line, said first drive shaft means being motorized and an energy transfer means is installed between said first and second drive shaft means;

at least two threaded drive slide block means comprising right and left hand thread means, respectively, said drive slide blocks having shutter drive pins installed therein, said pins extending upward at right angles to said drive slide blocks, said drive slide blocks are threadedly disposed in a non-rotatable mode on said first drive shaft means equadistant from said devices vertical center line;

at least two threaded drive slide blocks means comprising right and left hand thread means, respectively, said drive slide blocks having shutter drive pins installed therein, said pins extending downward at right angles to said drive slide blocks, said drive slide blocks are threadedly disposed in a non-rotating mode on said second drive shaft means equadistant from said devices vertical center line and at a dimension corresponding to the space between the drive slide blocks installed on the first drive shaft means; and at least one insulated shutter shield means is installed on each side of said devices vertical center line, said shutters are maintained in said upper and lower track means, and supported on a low friction slide means, said shutter shield means are engaged with said upper and lower shutter drive pins; whereby said shutters are traversible to an opened or closed mode.

5. An improved insulated shutter shield device in combination with a glass area installed in a building wall as recited in claim 1, said device having upper and lower track means housing a motorized shutter shield traversing means;

wherein the improvement comprises:

an opposing shutter shield drive pin means is installed in said shutter shield means, said pins are disposed, engaging said upper and lower motorized traversing means, said drive pin means having quick release means, whereby said shutter shield means is separated from said motorized traversing means, thereby providing for manual operation of said insulated shutter shield means during a break down of said motorized traversing means or during emergencies.

6. An improved building structure with upright walls having a glass area means commonly called a window or glass sliding door installed therein, said glass area means including a frame and a glass panel means mounted in said frame, in combination with an insulated shutter shield device having upper and lower track means spaced inwardly of said glass area at least one height dimension of said glass area frame and attached to the internal wall structural framing of said building wall structure and parallel to the plane of said glass area means;

laminate insulative shutter shield means mounted in said track means for movement between positions adjacent to the side of said glass area means and in front thereof, to block off the entirety of said glass area means, low friction means for supporting said laminate insulative shutter shield means for movement on said track means, said laminate insulative shutter shield means having rigidifying means and an insulative material layer mounted side by side, said insulative material having little resistance against breakage when forces are applied in direction perpendicular to the plane thereof, said rigidifying means providing a rigidification of said insulative material against the effects caused by forces applied from the outside, and seal means for effecting a seal around the periphery of said glass area means and between said glass area means and said insulative shutter shield means, thereby defining a sealed chamber;

said improved insulative shutter shield device having a motorized means for traversing said insulative shutter shield means to an opened or closed mode, wherein the improvement comprises;

means for maintaining said upper and lower track means in a parallel mode of precision alignment, said means being vertical support members, spaced parallel at right angles to said track means with means to fasten said vertical support members to said upper and lower track means;

means for traversing said shutter shield means, said means being first and second motorized, threaded drive shaft means maintained in a mode of rotatable precision alignment housed respectively in said lower and upper track means;

at least two slide block means having a shutter drive pin means installed therein, extending vertically at right angles to said slide block means, said drive slide block means are threadedly disposed respectively in a non-rotatable mode on said upper and lower threaded drive shaft means, having said extended shutter drive pins facing toward the horizontal center line of said device, said pins being vertically aligned;

an energy transfer means is installed between said lower and upper threaded drive shaft means; and at least one insulated shutter shield means is installed in said upper and lower track means engaging said upper and lower extending shutter drive pin means; whereby said shutter shield can be motor traversed to an opened or closed mode.

7. An improved building structure with upright walls having glass area means commonly called a window or glass sliding door installed therein, said glass area means including a frame and a glass panel means mounted in said frame, in combination with an insulated shutter shield device having upper and lower track means spaced inwardly of said glass area means at least one height dimension of said glass area frame and attached to the internal wall structural framing of said building wall structure and parallel to the plane of said glass area means; laminate insulative shutter shield means mounted in said track means for movement between positions adjacent to the sides of said glass area means and in front thereof, to block off the entirety of said glass area means, low friction means for supporting said laminate insulative shutter shield means for movement on said track means, said laminate insulative shutter shield means having rigidifying means an insulative material layer mounted side by side, said insulative material layer having little resistance against breakage when forces are applied in the direction perpendicular to the plane thereof, said rigidifying means providing a rigidification of said insulative material against the effects caused by forces applied from the outside, and seal means for effecting a seal around the periphery of said glass area means and between said glass area means and said insulative shutter shield means, thereby defining a sealed chamber;

said improved insulative shutter shield device having a motorized means for traversing said insulative shutter shield means to an opened or closed mode, wherein the improvement comprises;

said traversing means having a first motorized threaded drive shaft means with right hand thread means disposed on one side of the vertical center line of said drive shaft means and left hand thread means disposed on the opposite side, said drive shaft means is maintained in a mode of rotatable precision alignment, housed in said lower track means;

at least two drive slide block means having shutter drive pin means installed therein, extending vertically at right angles to said drive slide block means, said drive slide block means are threadedly disposed in a non-rotatable mode on said drive shaft means equadistant from said drive shaft vertical center line;

a second threaded drive shaft means having right hand thread means disposed on one side of the vertical center line of said drive shaft means and left hand thread means disposed on the opposite side, maintained in a mode of rotatable precision alignment housed in said upper track means;

at least two drive slide block means having a shutter drive pin means therein, extending downward at right angles to said drive slide block, said drive slide block means are threadedly disposed in a non-rotatable mode on said opposing drive shaft thread means, equadistant from said upper track drive shaft vertical center line and at a dimension corresponding to the dimension between the drive slide blocks installed on the first drive shaft means;

vertical support members are spaced parallel apart with means to fasten to said upper and lower track means maintaining said lower and upper track means in a parallel mode of precision alignment;

an energy transfer means is installed between said first lower motorized threaded drive shaft means and said second threaded upper drive shaft means; and at least one insulated shutter shield means is installed in said track means on each side of said vertical center line, engaging said shutter drive pin means, extending from the lower and upper track means drive slide blocks; whereby said insulated shutter shield means are motor traversed toward each other to a closed mode or motor traversed away from each other to an opened mode.

* * * * *